US009199209B2

(12) United States Patent
Xiong et al.

(10) Patent No.: US 9,199,209 B2
(45) Date of Patent: Dec. 1, 2015

(54) INTERACTION CHAMBER WITH FLOW INLET OPTIMIZATION

(75) Inventors: Renqiang Xiong, Newton, MA (US); John Michael Bernard, Stoughton, MA (US)

(73) Assignee: MICROFLUIDICS INTERNATIONAL CORPORATION, Westwood, MA (US)

( * ) Notice: Subject to any disclaimer, the term of this patent is extended or adjusted under 35 U.S.C. 154(b) by 1261 days.

(21) Appl. No.: 13/085,939

(22) Filed: Apr. 13, 2011

(65) Prior Publication Data

US 2012/0263013 A1 Oct. 18, 2012

(51) Int. Cl.

| | |
|---|---|
| ***B01F 15/02*** | (2006.01) |
| ***B01F 13/00*** | (2006.01) |
| ***B01F 5/02*** | (2006.01) |

(52) U.S. Cl.

CPC ..... *B01F 13/0059* (2013.01); *B01F 5/0256* (2013.01); *B01F 2215/0032* (2013.01)

(58) Field of Classification Search

CPC .... B01F 5/0256; B01F 5/0057; B01F 5/0077; B01F 5/064; F16K 19/00

USPC ..... 366/162.4, 177.1

See application file for complete search history.

(56) References Cited

U.S. PATENT DOCUMENTS

| | | | | |
|---|---|---|---|---|
| 2,976,024 | A * | 3/1961 | Martinek | 366/162.4 |
| 3,409,042 | A * | 11/1968 | Anthony | 137/603 |
| 4,479,515 | A * | 10/1984 | Tippetts | 137/824 |
| 4,533,254 | A | 8/1985 | Cook et al. | |
| 4,634,134 | A | 1/1987 | Entrikin | |
| 4,684,072 | A | 8/1987 | Nelson et al. | |
| 4,746,069 | A | 5/1988 | Entrikin et al. | |
| 4,908,154 | A | 3/1990 | Cook et al. | |
| 5,314,506 | A | 5/1994 | Midler, Jr. et al. | |
| 5,417,956 | A | 5/1995 | Moser | |

(Continued)

FOREIGN PATENT DOCUMENTS

| | | |
|---|---|---|
| JP | H8-117578 | 5/1996 |
| JP | H9-169026 | 6/1997 |

(Continued)

OTHER PUBLICATIONS

International Search Report and Written Opinion dated Jul. 6, 2012 issued for International PCT Application No. PCT/US12/33324.

(Continued)

*Primary Examiner* — Jill Warden
*Assistant Examiner* — Brittany Fisher
(74) *Attorney, Agent, or Firm* — K&L Gates LLP

(57) ABSTRACT

A mixing assembly includes an inlet, an outlet and a mixing chamber, the inlet is fluidly connected to the outlet through a plurality of micro fluid flow paths in a direction perpendicular from the inlet. The micro fluid flow paths fluidly connect to the perpendicular inlet via a curved transition portion. The curved transition portion provides a more efficient flow path for the fluid to travel from the inlet to the micro fluid flow paths to the mixing chamber. By transitioning the direction change, flow resistance is decreased, and the fluid flow rate and shear rate is increased. Increased fluid flow rate and shear rate helps to increase consistency and quality of mixing, and to reduce particle size of the fluid in the mixing chamber.

49 Claims, 9 Drawing Sheets

(56) References Cited

U.S. PATENT DOCUMENTS

| | | | | |
|---|---|---|---|---|
| 5,466,646 | A | 11/1995 | Moser | |
| 5,533,254 | A | 7/1996 | Gallo et al. | |
| 5,570,955 | A | 11/1996 | Swartwout et al. | |
| 5,578,279 | A | 11/1996 | Dauer et al. | |
| 5,615,949 | A | 4/1997 | Morano et al. | |
| 5,620,147 | A | 4/1997 | Newton | |
| 5,961,932 | A | 10/1999 | Ghosh et al. | |
| 6,159,442 | A | 12/2000 | Thumm et al. | |
| 6,221,332 | B1 | 4/2001 | Thumm et al. | |
| 6,497,570 | B1 * | 12/2002 | Sears et al. | 431/178 |
| 6,558,435 | B2 | 5/2003 | Am Ende et al. | |
| 6,607,784 | B2 | 8/2003 | Kipp et al. | |
| 6,869,617 | B2 | 3/2005 | Kipp et al. | |
| 6,932,914 | B2 | 8/2005 | LeClair | |
| 6,960,307 | B2 | 11/2005 | LeClair | |
| 6,977,085 | B2 | 12/2005 | Werling et al. | |
| 7,297,288 | B1 | 11/2007 | LeClair | |
| 7,326,054 | B2 | 2/2008 | Todd et al. | |
| 2002/0097633 | A1 | 7/2002 | O'Connor et al. | |
| 2003/0039169 | A1 | 2/2003 | Ehrfeld et al. | |
| 2003/0043689 | A1 * | 3/2003 | Jang et al. | 366/165.2 |
| 2003/0165079 | A1 | 9/2003 | Chen et al. | |
| 2003/0189871 | A1 * | 10/2003 | Brick et al. | 366/162.4 |
| 2003/0206959 | A9 | 11/2003 | Kipp et al. | |
| 2004/0266890 | A1 | 12/2004 | Kipp et al. | |
| 2005/0191359 | A1 | 9/2005 | Goldshtein et al. | |
| 2006/0151899 | A1 | 7/2006 | Kato et al. | |
| 2006/0187748 | A1 * | 8/2006 | Kozyuk | 366/162.4 |
| 2007/0291581 | A1 * | 12/2007 | Ehrfeld et al. | 366/153.2 |
| 2008/0038333 | A1 | 2/2008 | Magadassi et al. | |
| 2009/0071544 | A1 * | 3/2009 | Serafin et al. | 137/88 |
| 2009/0269250 | A1 * | 10/2009 | Panagiotou et al. | 422/129 |
| 2009/0297565 | A1 | 12/2009 | Muller et al. | |
| 2010/0051128 | A1 * | 3/2010 | Ezaki | 137/597 |
| 2011/0002781 | A1 * | 1/2011 | Presz et al. | 415/211.2 |

FOREIGN PATENT DOCUMENTS

| | | |
|---|---|---|
| JP | 2003-311136 | 11/2003 |
| JP | 2006-021471 | 1/2006 |
| JP | 2006-341146 | 12/2006 |
| JP | 2008-037842 | 2/2008 |
| JP | 2008-081772 | 4/2008 |
| WO | 99/07466 | 2/1999 |
| WO | 2005/018687 | 3/2005 |
| WO | 2007/051520 | 5/2007 |
| WO | 2007/148237 | 12/2007 |

OTHER PUBLICATIONS

Sonolator Product Literature.

Gruverman, Breakthrough Ultraturbulent Reaction Technology Opens Frontier for Developing Life-Saving Nanometer-Scale Suspensions & Dispersions, Ultraturbulent Reaction Technology publication, Jan./Feb. 2003, vol. 3, No. 1 (4 pages).

Gruverman, A Drug Delivery Breakthrough—Nanosuspension Formulations for Intravenous, Oral & Transdermal Administration of Active Pharmaceutical Ingredients, Nanosuspension Formulations publication, Sep. 2004, vol. 4, No. 7, ppl. 58-59.

Gruverman, Nanosuspension Preparation and Formulation, Nanosuspension Formulation publication, Sep. 2005, vol. 5, No. 8, pp. 1-4.

Gruverman, Optimizing Drug Delivery—Formulation Development and Scaleable Manufacturing Methodology, Nanoemulsions and Nanosuspensions Prepared by Ultrahigh-Shear Fluid Processing, Presentation at Particles 2006, May 14, 2006.

Gruverman et al., Production of Nanostructures Under Ultraturbulent Collision Reaction Conditions—Application to Catalysts, Superconductors, CMP Abrasives, Ceramics and Other Nanoparticles, undated.

Panagiotiou, et al., Production of Stable Drug Nanosuspensions Using Microfluidics Reaction Technology, Poster Session, single page, undated.

Gruverman, Advances in Continuous Chemical Reactor Technology, Oct. 30, 2006, retrieved online Jun. 2, 2009, URlhttp://aimediaserver4com/chemeng/pdf/feature-oct06.pdf, Figure V, p. 5.

PCT International Search Report dated Jun. 15, 2009 (PCT/US2009/041511).

Johnson, et al., Chemical Processing and Micromixing in Confined Impinging Jets, AIChE Journal, vol. 49, No. 9, Sep. 2003, pp. 2264-2282.

U.S. Appl. No. 12/986,477, filed Jan. 7, 2011.

U.S. Appl. No. 13/085,903, filed Apr. 13, 2011.

* cited by examiner

INTERACTION CHAMBER WITH FLOW INLET OPTIMIZATION

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

CROSS-REFERENCE TO RELATED APPLICATIONS

This application expressly incorporates by reference, and makes a part hereof, U.S. patent application Ser. No. 12/986,477 and the U.S. patent application Ser. No. 13/085,903 filed on behalf of the same inventors concurrently with the present application.

BACKGROUND OF THE INVENTION

For certain pharmaceutical applications, manufacturers need to process and mix expensive liquid drugs for testing and production using the lowest possible volume of fluid to save money. Current mixing devices operate by pumping the fluid to be mixed under high pressure through an assembly that includes two mixing chamber elements secured within a housing. Each of the mixing chamber elements provides fluid paths through which the fluid travels prior to being mixed together. The fluid paths at the discharge end of each of the mixing chamber elements mix with one another under high pressure, resulting in the high energy dissipation. As the fluid is more efficiently pumped through the fluid paths, the amount of energy dissipated and the thoroughness of the mixing of the fluid in the mixing chamber increases. Due to the geometry of the fluid paths, current mixing chambers have increased flow resistance and therefore decreased exit fluid flow rates. As a result, these mixing chambers require higher energy and pressure at the input of the mixing chamber to overcome the flow inefficiencies and achieve acceptable mixing conditions.

DETAILED DESCRIPTION

Figure 1:
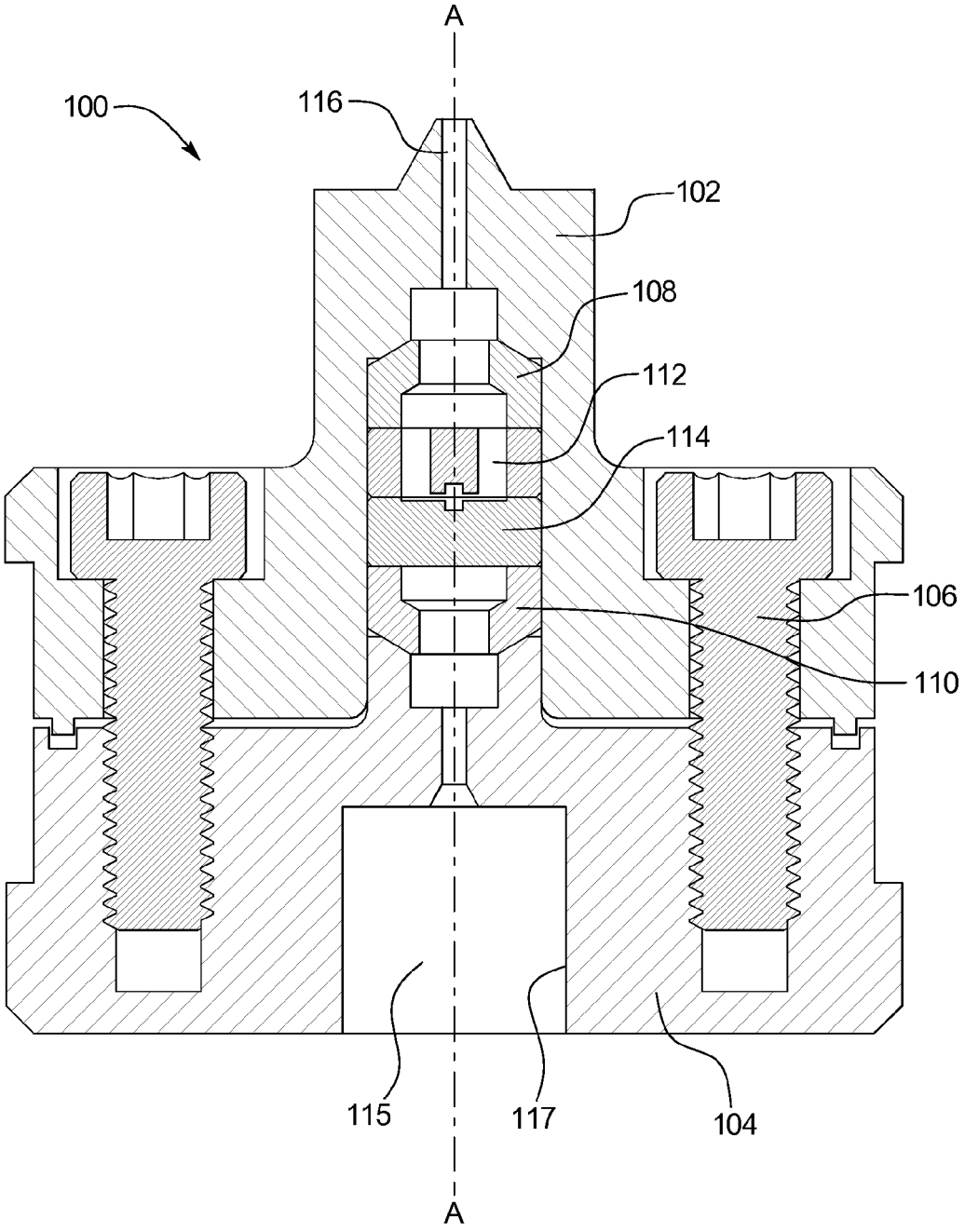
FIG. 1 is a cross-sectional view of an example assembled interaction chamber taken along line X-X of FIG. 2, according to one example embodiment of the present invention.

The present disclosure is generally directed to an interaction chamber that includes mixing chamber elements with curved flow inlets to reduce flow resistance and increase discharge fluid flow rate. The curved flow inlets result in the superior mixture of fluid using less energy than current mixing devices. By decreasing the flow resistance in the curved inlet of the mixing chamber elements, the fluid flow rate entering the mixing chamber elements can be increased as well, resulting in significant energy savings without sacrificing quality and consistency of the mixing.

The curved inlets are part of an interaction chamber, as described in U.S. patent application Ser. No. 12/986,477, which is incorporated herein by reference. Also incorporated herein by reference is U.S. patent application Ser. No. 13/085,903 directed to a mixing chamber with an impinging micro fluid flow path configuration. It should be appreciated, however, that the curved inlets of the present disclosure described in greater detail below can be implemented into any suitable mixing device, and are not limited to the interaction chamber illustrated or discussed in U.S. application Ser. No. 12/986,477 or the interaction chamber illustrated and discussed in U.S. patent application Ser. No. 13/085,903.

The interaction chamber of the present disclosure includes, among other components: a first housing; a second housing; an inlet retaining member; an outlet retaining member; an inlet mixing chamber element; and an outlet mixing chamber element. When assembled, the inlet retaining member and the outlet retaining member are situated facing one another within a first opening of the first housing. The inlet and outlet mixing chamber elements reside adjacent one another and between the inlet and outlet retaining members within the first opening. The second housing is fastened to the first housing such that a male protrusion on the second housing is inserted into the first opening making contact with the second retaining member. When the first and second housings are fastened together, the first retaining member and second retaining member are forced toward one another, thereby compressing the inlet and outlet retaining members and properly aligning the inlet and outlet mixing chamber elements together. The mixing chamber elements are further secured for high pressure mixing by the hoop stress exerted on the inlet and outlet mixing chamber elements by the inner wall of the first opening, as will be explained in further detail below.

As discussed below, in the interaction chamber of the present disclosure, the mixing chamber elements are secured using both compression from the torque of fastening two housings together as well as hoop stress of the inner walls of the first housing directed radially inwardly on the mixing chamber elements. However, rather than using a tube member that would need to be stretched to hold the mixing chamber elements radially, the first housing is heated prior to insertion of the mixing chamber elements, and allowed to cool and contract once the mixing chamber elements are inserted and aligned. By securing the mixing chamber elements with the hoop stress of the first housing applied as a result of thermal expansion and contraction, the torque required to compress the mixing chamber elements together is significantly reduced. Therefore, the interaction chamber can be reduced in size, number of components, and complexity that results in a significant reduction in holdup volume.

Figure 2:
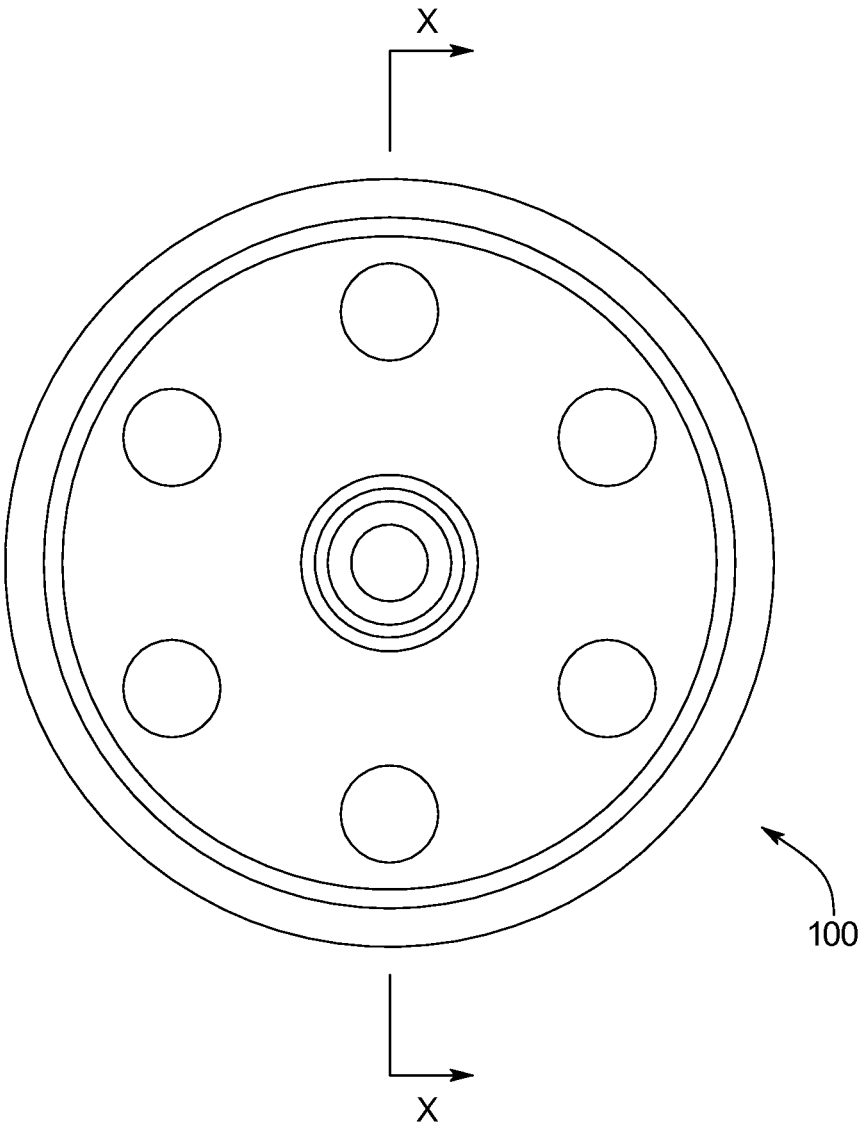
FIG. 2 is a top view of the assembled example interaction chamber according to one example embodiment of the present invention.
Figure 3:
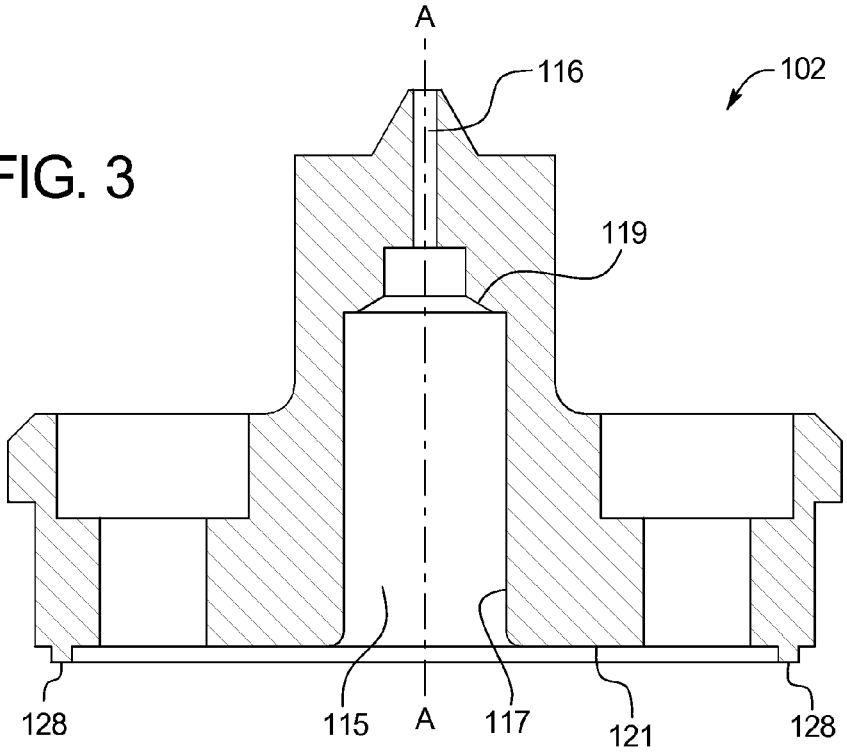
FIG. 3 is a cross-sectional view of the first housing of the example interaction chamber taken along line X-X of FIG. 2 according to one example embodiment of the present invention.
Figure 4:
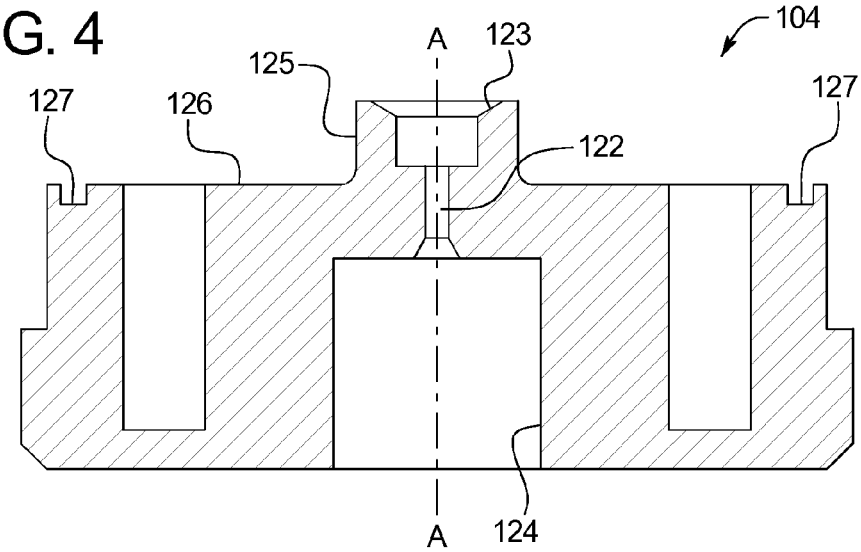
FIG. 4 is a cross-sectional view of the second housing of the example interaction chamber taken along line X-X of FIG. 2 according to one example embodiment of the present invention.
Figure 5:
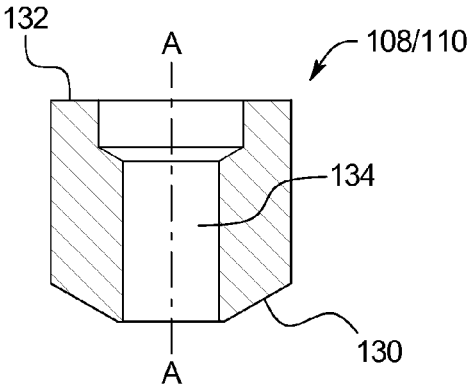
FIG. 5 is a cross-sectional view of the retaining element of the example interaction chamber taken along line X-X of FIG. 2 according to one example embodiment of the present invention.
Figure 10:
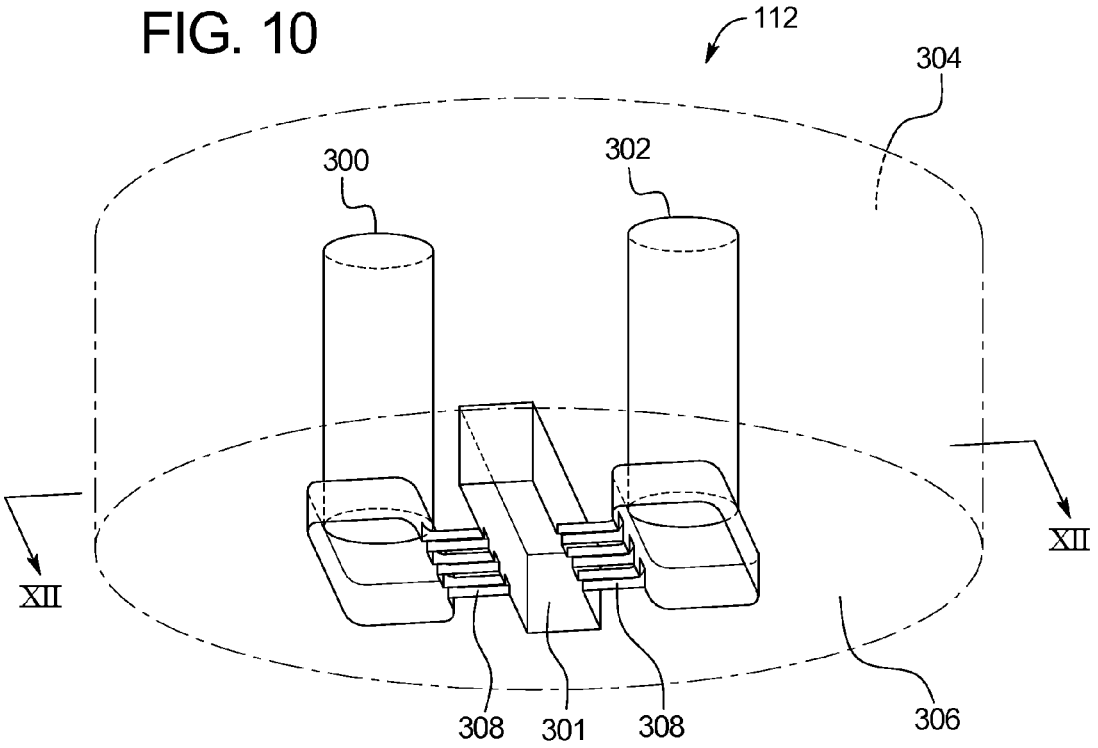
FIG. 10 is a perspective cross-sectional view of an inlet mixing chamber element according to one example embodiment of the present invention.
Figure 11:
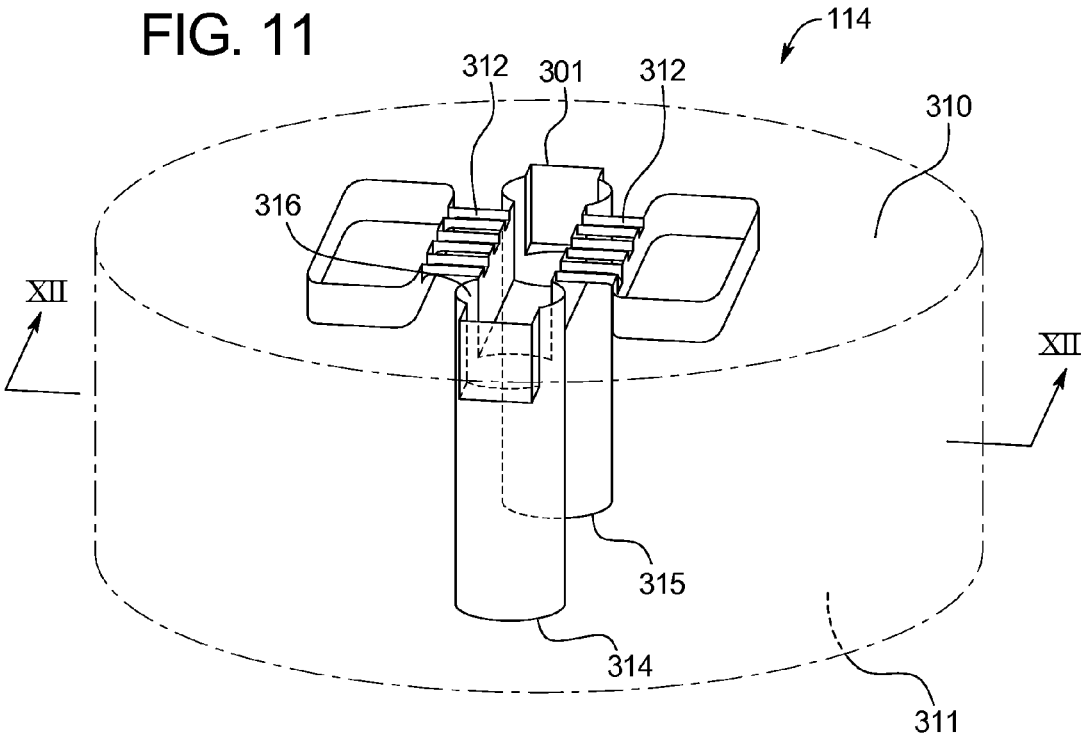
FIG. 11 is a perspective cross-sectional view of an outlet mixing chamber element according to one example embodiment of the present invention.
Figure 12:
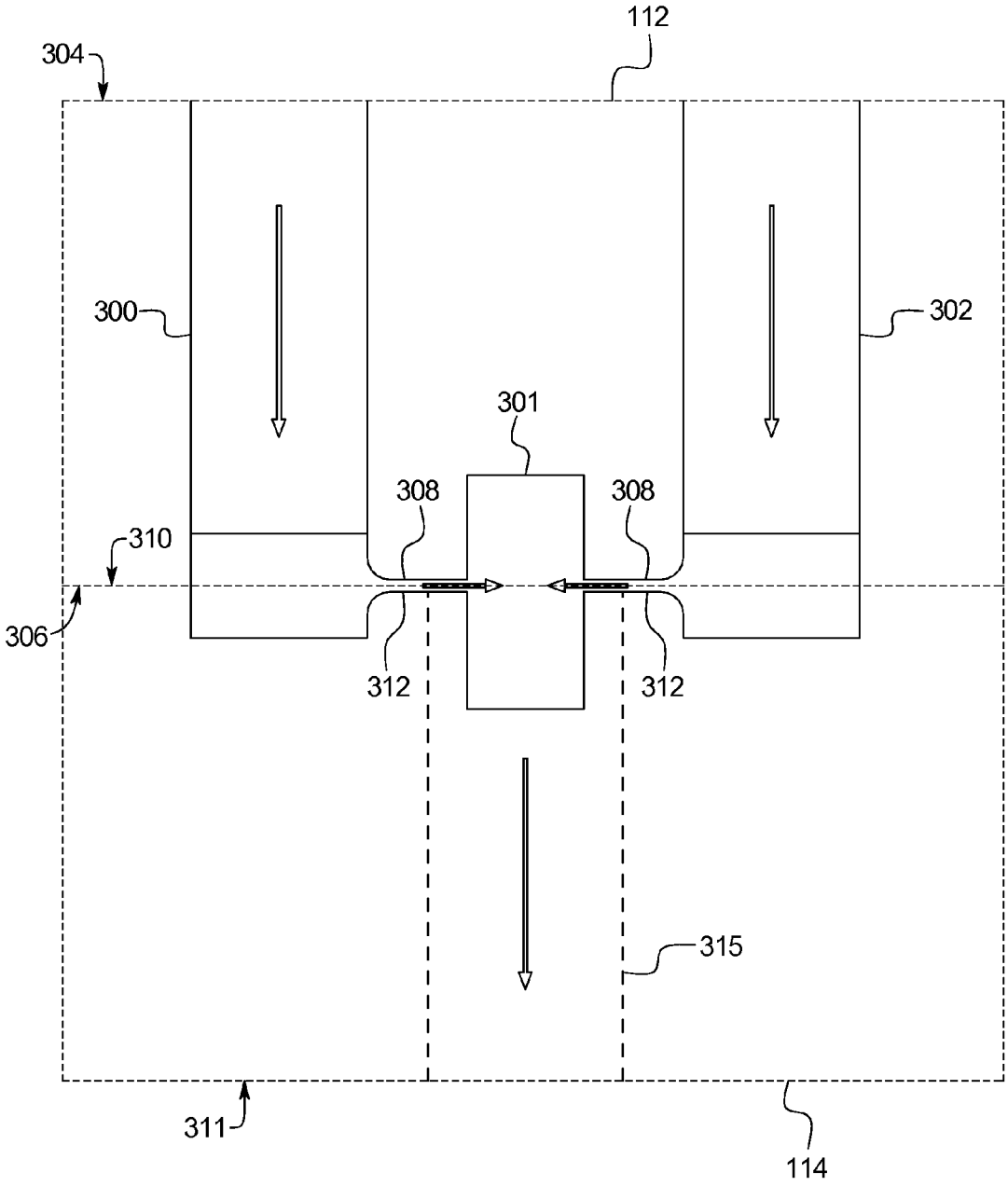
FIG. 12 is a side cross-sectional view of the inlet and outlet mixing chamber elements taken along line XII-XII of FIGS. 10 and 11 according to one example embodiment of the present invention.

Referring now to FIGS. 1 to 5 and 10 to 12, various example embodiments of the interaction chamber are illustrated. FIG. 2 illustrates a cross-sectional view of the assembled interaction chamber assembly 100 taken along the line X-X of the top view shown in FIG. 2. FIG. 3 illustrates the first housing 102 in detail, FIG. 4 illustrates the second housing 104 in detail and FIG. 5 illustrates the inlet/outlet retainer 108/110 in detail. FIG. 10 illustrates the inlet mixing chamber element 112 in detail and FIG. 11 illustrates the outlet mixing chamber element 114 in detail. FIG. 12 illustrates a cross-sectional side view of the inlet mixing chamber element 112 and the outlet mixing chamber element 114 assembled together.

As seen in FIG. 1, the assembled interaction chamber 100 may include a generally cylindrically shaped first housing 102 and a generally cylindrically shaped second housing 104. The first housing 102 is configured to be operably fastened to the second housing 104 using any sufficient fastening technology. In the illustrated example embodiment, the first housing 102 is fastened to the second housing 104 with a plurality of bolts 106 arranged in a circular array around a central axis A. It should be appreciated that the generally cylindrically shaped first housing 102 and the generally cylindrically shaped second housing 104 share central axis A when assembled.

Between the first housing 102 and the second housing 104 resides an inlet retainer 108, an outlet retainer 110, an inlet mixing chamber element 112 and outlet mixing chamber element 114. The inlet retainer 108 is arranged adjacent to the inlet mixing chamber element 112. The inlet mixing chamber element 112 is arranged adjacent to the outlet mixing chamber element 114, which is arranged adjacent to the outlet retainer 110. When the interaction chamber 100 is assembled, bolts 106 clamp the first housing 102 to the second housing 104, thereby compressing the inlet mixing chamber element 112 and outlet mixing chamber element 114 between the inlet retainer 108 and the outlet retainer 110.

After assembly, an unmixed fluid flow is directed into inlet 116 of the first housing 102, and through an opening 118 in inlet retainer 108. As discussed in more detail below, the unmixed fluid flow is then directed through a plurality of small pathways in the inlet mixing chamber element 102 in the direction of the fluid path. The fluid then flows in a direction parallel to the face of the inlet mixing chamber element 112 and the face of the adjacent outlet mixing chamber element 114 through a plurality of microchannels formed between the inlet mixing chamber element 112 and the outlet mixing chamber element 114. The fluid is mixed when the plurality of micro channels converge. The mixed fluid is directed through a plurality of small pathways in the outlet mixing chamber element 114, through an opening 120 in outlet retainer 110, and through outlet 122 of the second housing 104.

It should be appreciated that the plurality of bolts 106 used to fasten the first housing 102 to the second housing 104 provide a clamping force sufficient to compress the inlet mixing chamber element 112 and the outlet mixing chamber element 114 so that the microchannels formed between the two faces are fluid tight. However, due to the high pressure and the high energy dissipation resulting from the mixing taking place between the inlet mixing chamber element 112 and the outlet mixing chamber element 114, the compression force applied by the torqued bolts 106 alone may not be sufficient to hold the mixing chamber elements static within the first opening of the first housing 102 during mixing. Thus, in addition to the compressive force applied by the bolts 106, the mixing chamber elements 112, 114 are held circumferentially by the inner wall 117 of the first opening 115 of the first housing 102, which applies a large amount of hoop stress directed radially inwardly on the mixing chamber elements, as will be further discussed below. This secondary point of retention and security reduces the required amount of compressive force to hold the mixing chamber elements in place during high pressure and high energy mixing and prevents the mixing chamber elements cracking at high pressures.

For example, due to the hoop stress applied to the mixing chamber elements, each of six bolts 106 in one embodiment need only a torque force of 100 inch-pounds to hold the mixing chamber elements together to create a seal. Prior art devices that use primarily compression to secure the mixing chamber elements as discussed above, however, tend to require significantly higher amounts of torque force to hold the mixing chamber elements together to create a seal (about 130 foot-pounds of torque). Because the prior art devices use a tube member that must be stretched to decrease its diameter and clamp down on the mixing chamber elements, the prior art devices require larger housings, more components and therefore, a higher hold-up volume of approximately 0.5 ml. In one embodiment of the present disclosure, the mixing chamber elements are secured within the first opening of the first housing and achieve the high hoop stress imparted from the inner wall of the first housing onto the outer circumference of the mixing chamber elements, the present disclosure takes advantage of precision fit components and the properties of thermal expansion. The hold-up volume of the interaction chamber of the present disclosure is around 0.05 ml.

An example procedure for assembling one embodiment of the interaction chamber of the present disclosure are now described with reference to the assembled interaction chamber in FIG. 1 and each individual component illustrated in FIGS. 3 to 5 and 10 to 12.

First, the inlet retaining member 108, as shown in FIGS. 1 and 5, may be inserted into the first opening of the first housing, as shown in FIG. 3. The inlet retaining member 108 has a substantially cylindrical shape, and fits concentrically within the first opening of the first housing. When inserted, the inlet retaining member 108 includes a chamfered surface 130 that is configured contact a complimentary chamfered interior surface 119 of the first housing 102. This chamfered mating between the first housing 102 and the inlet retaining member 108 ensures that the inlet retaining member 108 self-centers within the first opening and lines up properly and squarely to the inner wall 117 of the first opening 115. It should be appreciated that the inlet retaining member 108 includes a concentric passageway 134 which allows fluid to flow through the inlet retaining member 108. The passageway 134 lines up with flow path 116 of the first housing 102, through which the unmixed fluid is pumped from a separate component in the mixing system.

Second, the first housing 102 may be heated to at least a predetermined temperature, at which point the first opening 115 expands from a first opening diameter to at least a first opening expanded diameter. In some example embodiments, the first housing is made of stainless steel, and the first housing is heated using a hot plate or any other suitable method of heating stainless steel. In one such embodiment, the predetermined temperature at which the first housing is heated is between 100° C. and 130° C. It should be appreciated that, when the first opening 115 is at the first diameter, the mixing chamber elements 112, 114 are unable to fit within the first opening 115. However, the mixing chamber components 112, 114 are manufactured and toleranced such that, after the first housing 102 is heated and the first diameter expands to the first expanded diameter, the mixing chamber elements 112, 114 are able to fit within the first opening 115. In one embodiment, the first expanded diameter is between 0.0001 and 0.0002 inches larger than the first diameter.

Third, the inlet mixing chamber element 112 is inserted into the first opening 115 of the heated first housing 102. The top surface 304 of the inlet mixing chamber element 112 is configured to be in contact with the bottom surface 132 of inlet retaining member 108. Because the inlet retaining member 108 is self-aligned with the chamfered mating surfaces of 119 and 130, the inlet mixing chamber element 112 is also properly aligned when surface 304 makes complete contact with surface 132 of inlet retaining member 108.

Fourth, the outlet mixing chamber element 114 is inserted into the first opening 115 of the heated first housing 102. The top surface 310 of the outlet mixing chamber element 114 is configured to be in contact with the bottom surface 306 of the inlet mixing chamber element 112. It should be appreciated that in some embodiments, the surface 306 and surface 310 include complimentary features that ensure the inlet mixing chamber element 112 is properly oriented and aligned with the outlet mixing chamber element 114. For example, in one embodiment, the inlet mixing chamber element 112 includes one or more protrusions that fit one or more complimentary recesses in the outlet mixing chamber element 114 so as to ensure proper rotational alignment of the two mixing chamber elements.

Fifth, once the mixing chamber elements 112, 114 are arranged within the first opening 115 of the heated first housing 102, the outlet retaining member 110 may be inserted into the first opening 115. The outlet retaining member 110 is substantially similar in structure to the inlet retaining member 108. Similar to the inlet retaining member 108, surface 132 of the outlet retaining member 110 is configured to make contact with surface 312 of the outlet mixing chamber element 114.

Sixth, the second housing 104 is aligned with the first housing 102 and the assembled first and second housings are operatively fastened together. As seen in FIG. 3, the second housing 104 includes protrusion 125 extending from top surface 126. When the first housing 102 is aligned with the second housing 104, protrusion 125 fits into the first opening 115. Similar to the opposite end of the first opening 115, the protrusion 125 includes a complimentary chamfered surface 123, which is configured to contact the chamfered surface 130 of the outlet retaining member 110. Also similar to the first housing's contact with the inlet retaining member 108, the chamfered surface 123 of protrusion 125 ensures that the outlet retaining member 110 is square to the inner surface 117 of opening 115. When both the inlet retaining member 108 and the outlet retaining member 110 are properly aligned by the first housing 102 and the protrusion 125 of the second housing 104 respectively, the inlet mixing chamber element 112 and the outlet mixing chamber element 114 are correctly aligned within the first opening 115. If the mixing chamber elements 112, 114 are even slightly misaligned, the elements may be damaged due to incorrect holding forces and the high pressure of the mixing. Additionally, the mixing results will be less consistent and reliable if the mixing chamber elements are not perfectly aligned by the retaining members and the first and second housings.

Seventh, the first housing may be operatively fastened to the second housing so that the inlet retainer, the inlet mixing chamber element, the outlet mixing chamber element, the outlet retainer, and the male member of the second housing are in compression. In the illustrated embodiment, six bolts 106 may be used to fasten the first housing 102 to the second housing 104. To ensure equal clamping force between the first housing 102 and the second housing 104, the bolts 106 are spaced sixty degrees apart and equidistant from central axis A. As discussed above, the fastening of six bolts 106 provides sufficient clamping force to seal surface 306 of the inlet mixing chamber element with surface 310 of the outlet mixing chamber element. It will be appreciated that any appropriate fastening arrangement or numbers of bolts may be used.

Eighth, the first housing is allowed to cool down from its heated state. In various embodiments, the first housing is cooled down by allowing it to return to room temperature or actively causing it to cool with an appropriate cooling agent. When the first housing is cooled, the material of the first housing contracts back, and the first housing expanded diameter is urged to contract back to the first housing diameter. Because the mixing chamber elements are already arranged and aligned inside of the first opening of the first housing, the contracting diameter of the first opening exerts a high amount of force directed radially inwardly on the mixing chamber elements. This force, in combination with the compressive force applied from the six bolts 106, is sufficient to hold the mixing chamber elements in place for the high pressure mixing. It should be appreciated that the mixing chamber elements can be made of any suitable material to withstand the radially inward stress of 30,000 pounds per square inch applied when the first opening diameter contracts. In one embodiment, the mixing chamber elements are constructed with 99.8% alumina. In another embodiment, the mixing chamber elements are constructed with polycrystalline diamond.

In operation, when the inlet mixing chamber element 112 and the outlet mixing chamber element 114 are secured and held in the first housing between the inlet and outlet retaining members, surface 306 makes a fluid-tight seal with surface 310. The unmixed fluid is pumped through flow path 116 of the first housing 102, and through inlet retainer 108 to inlet mixing chamber element 112. At inlet mixing chamber element 112, the fluid is pumped at high pressure into ports 300 and 302, and then into the plurality of microchannels 308, described in more detail below. Due to the decrease in fluid port size from flow path 116 to ports 300, 302 to microchannels 308, the pressure and shear forces on the unmixed fluid becomes very high by the time it reaches the microchannels 308. As discussed above, and because of the secure holding between the inlet and outlet mixing chamber elements, microchannels 308 and 318 combine to form micro flow paths, through which the unmixed fluid travels. When the micro flow paths converge on one another, the high pressure fluid experiences a powerful reaction, and the constituent parts of the fluid are mixed as a result. After the fluid has mixed in the micro flow paths, the mixed fluid travels through outlet ports 314, 315 of outlet mixing chamber element 114.

Figure 6:
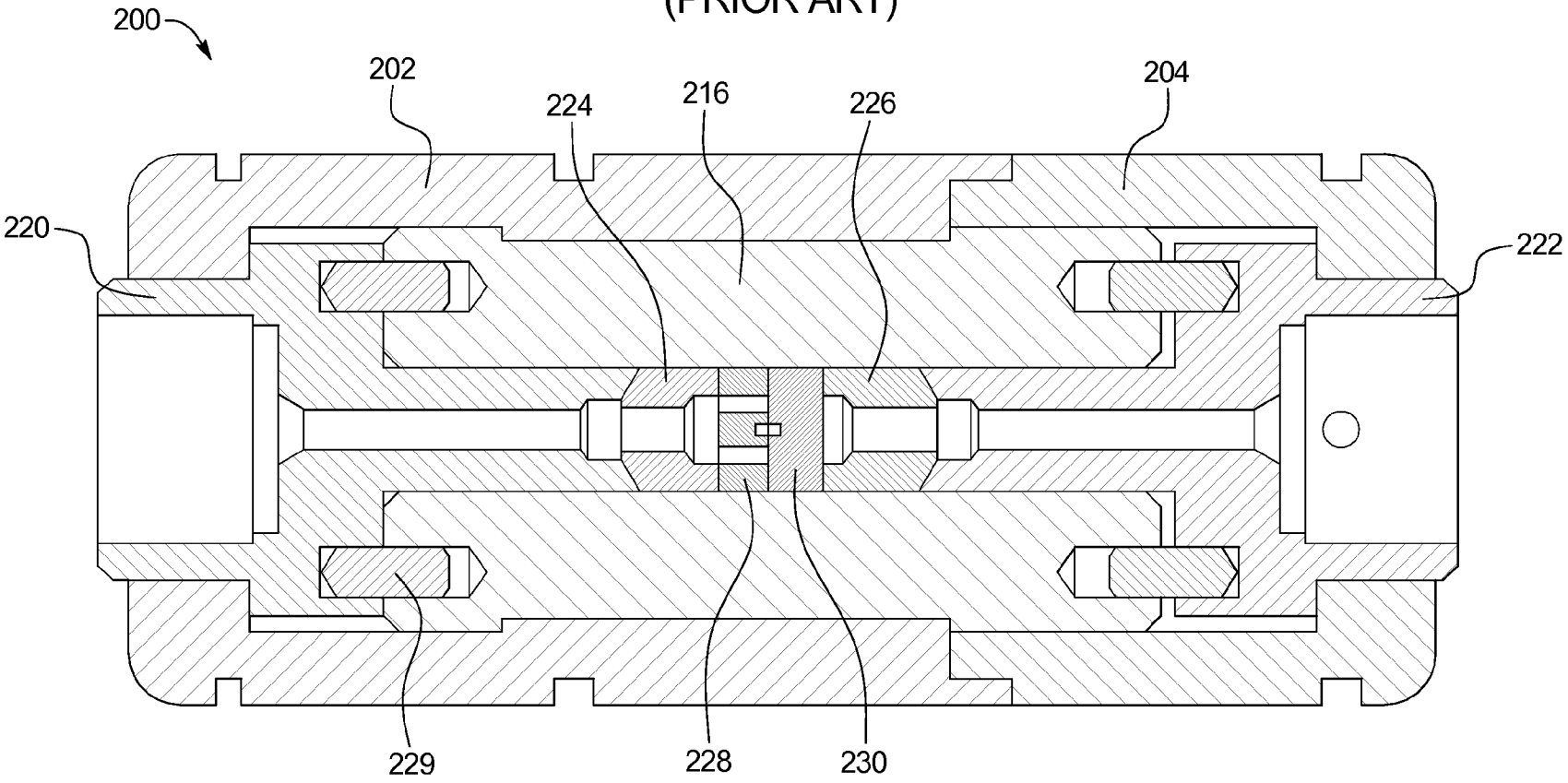
FIG. 6 (PRIOR ART)
FIG. 6 is a cross-sectional view of a prior art mixing device.

Referring now specifically to FIGS. 6 to 9, a prior art mixing chamber is illustrated and discussed. As seen in FIG. 6, a prior art mixing assembly is illustrated. The mixing assembly 200, which includes an inlet cap 202 and an outlet cap 204. The inlet cap 202 includes threads that are configured to engage complimentary threads on the outlet cap 204. The mixing assembly 200 also includes an inlet flow coupler 220, an outlet flow coupler 222, an aligning tube 221, an inlet retainer 224, an outlet retainer 226, an inlet mixing chamber element 228 and an outlet mixing chamber element 230.

The inlet flow coupler 220 is arranged within the inlet cap 202, and the outlet flow coupler 222 is arranged within the outlet flow cap 204. When assembled, the tube 221 stays aligned with both the inlet flow coupler 220 and the outlet flow coupler 222 with the use of a plurality of pins 229. The inlet retainer 224 and the outlet retainer 226 are arranged within the tube 221, and serve to align and retain the inlet mixing chamber element 228 and the outlet mixing chamber element 230. The inlet and outlet retainers 224 and 226 make contact with the inlet flow coupler 220 and the outlet flow coupler 222 respectively.

When the device is fully assembled, a flow path is formed between the inlet flow coupler 220, the inlet retainer 224, the inlet mixing chamber element 228, the outlet mixing chamber element 230, the outlet retainer 226 and the outlet flow coupler 222. The unmixed fluid enters the inlet flow coupler 220 and travels through the inlet retainer 224 and to the inlet mixing chamber element 228. Under high pressure and as a result of the high energy reaction, the unmixed fluid is mixed between the inlet mixing chamber element 228 and the outlet mixing chamber element 230. The mixed fluid then travels through the outlet retainer 226 and the outlet flow coupler 222. As will be described in greater detail below and illustrated in FIGS. 7 to 9, the pre-mix flow of the fluid follows a substantially right-angular flow path as it travels from the inlet of the ports downward and makes an approximately ninety degree turn toward the mixing chamber.

Figure 7:
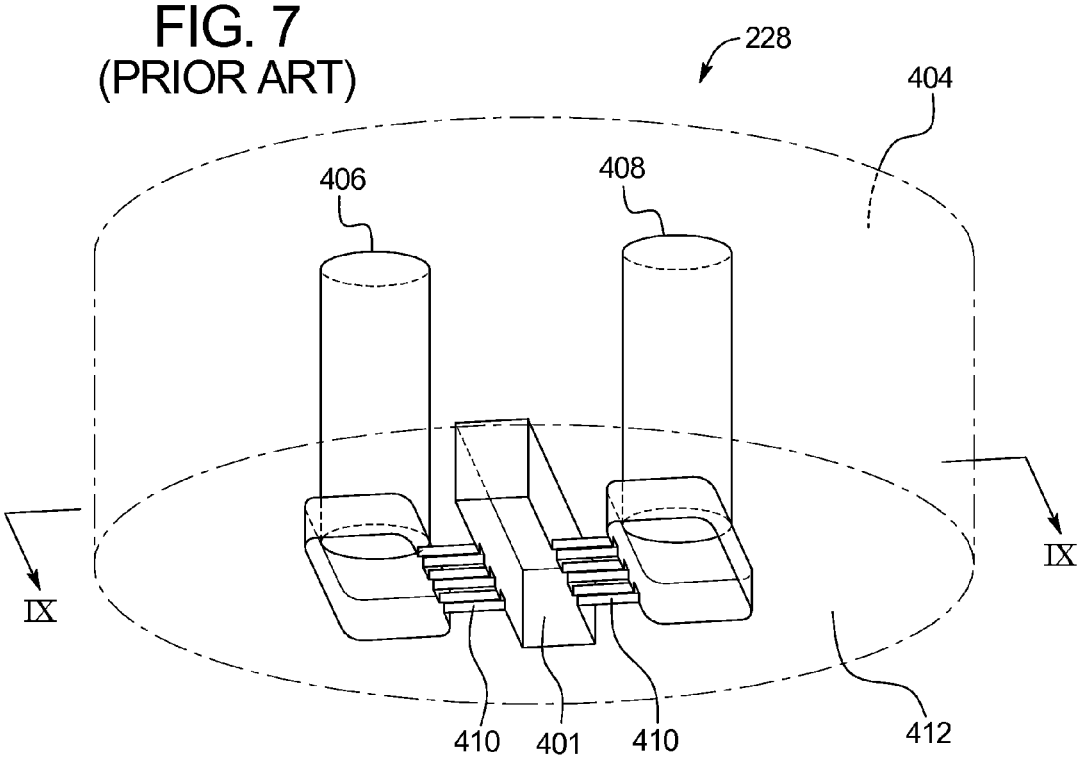
FIG. 7 (PRIOR ART)
FIG. 7 is a perspective cross-sectional view of an inlet mixing chamber element of a prior art device.

In FIG. 7, a prior art inlet mixing chamber element 228 corresponds to the inlet mixing chamber element 228 depicted in FIG. 6. The illustrated prior art inlet mixing chamber element 228 includes a top surface 404, a bottom surface 412 and a plurality of ports 406, 408 extending from the top surface 404 toward the bottom surface 412. On bottom surface 412 of the inlet mixing chamber element 228, one or more microchannels 410 are etched. The ports 406, 408 are in fluid communication with microchannels 410.

Figure 8:
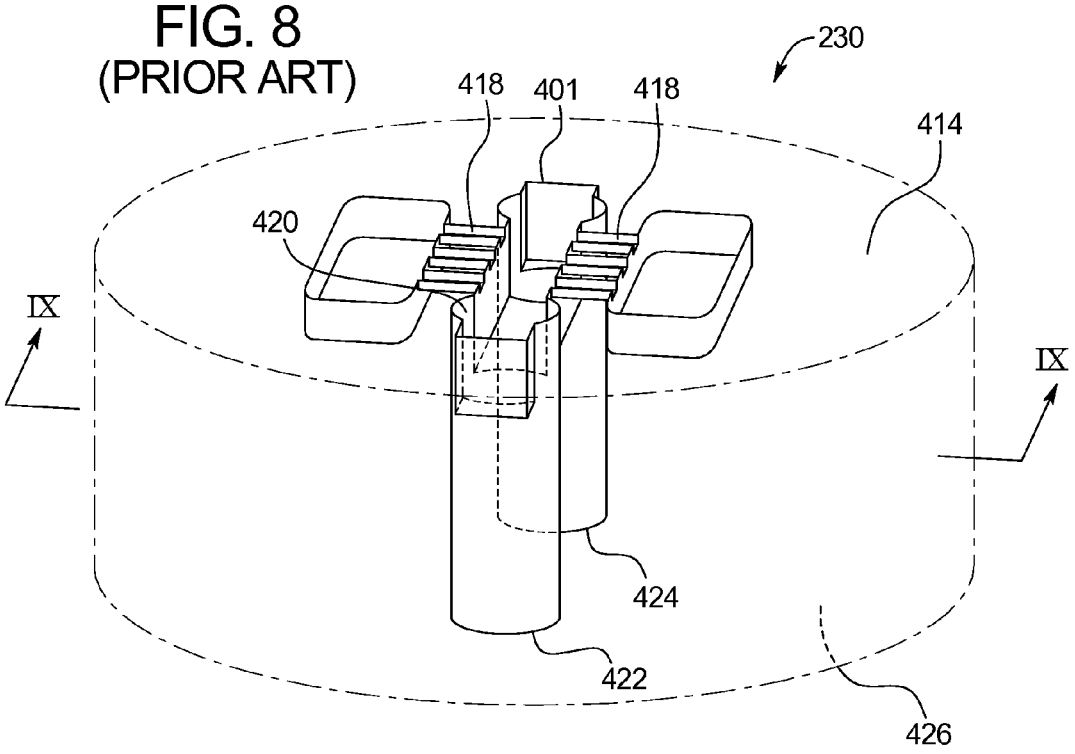
FIG. 8 (PRIOR ART)
FIG. 8 is a perspective cross-sectional view of an outlet mixing chamber element of a prior art device.

Similar to the prior art inlet mixing chamber element 228, a prior art outlet mixing chamber element 230 illustrated in FIG. 8 corresponds to the outlet mixing chamber element 230 depicted in FIG. 6 and discussed briefly above. The prior art outlet mixing chamber element 230 includes top surface 414, bottom surface 426 and a plurality of ports 422, 424 extending from top surface 414 to bottom surface 426. On top surface 414, one or more microchannels 418 are etched. The ports 422 and 424 are in fluid communication with the microchannels 416. It should be appreciated that the microchannels 418 of the outlet mixing chamber element 230 and the microchannels 410 of the inlet mixing chamber element 228 complement one another such that, when the inlet mixing chamber element 228 and the outlet mixing chamber element 230 are pressed sealingly together in the mixing assembly, as shown in FIG. 1, microchannels 410 and 418 create fluid pathways. In the illustrated prior art embodiment, three fluid pathways are arranged on either side of the mixing chamber. Each fluid pathway has a complementary fluid pathway directly opposite the mixing chamber.

In one example of the assembled prior art device, the fluid is pumped under high pressure through the fluid pathway defined from the top surface 404 of the inlet mixing chamber element 228 through ports 406 and 408 to the microchannels formed by 410 on the inlet mixing chamber element 228 and microchannels 418 on the outlet mixing chamber element 430. The fluid discharged from each of the fluid pathways flows under high pressure and high speed so that when it collides with fluid flowing from its complementary fluid path, the two fluid streams mix in the mixing chamber 401. In the mixing chamber 401, the fluid is broken down into small particles and mixed. The mixed fluid then exits the output mixing chamber element 230 through ports 422 and 424.

Figure 9:
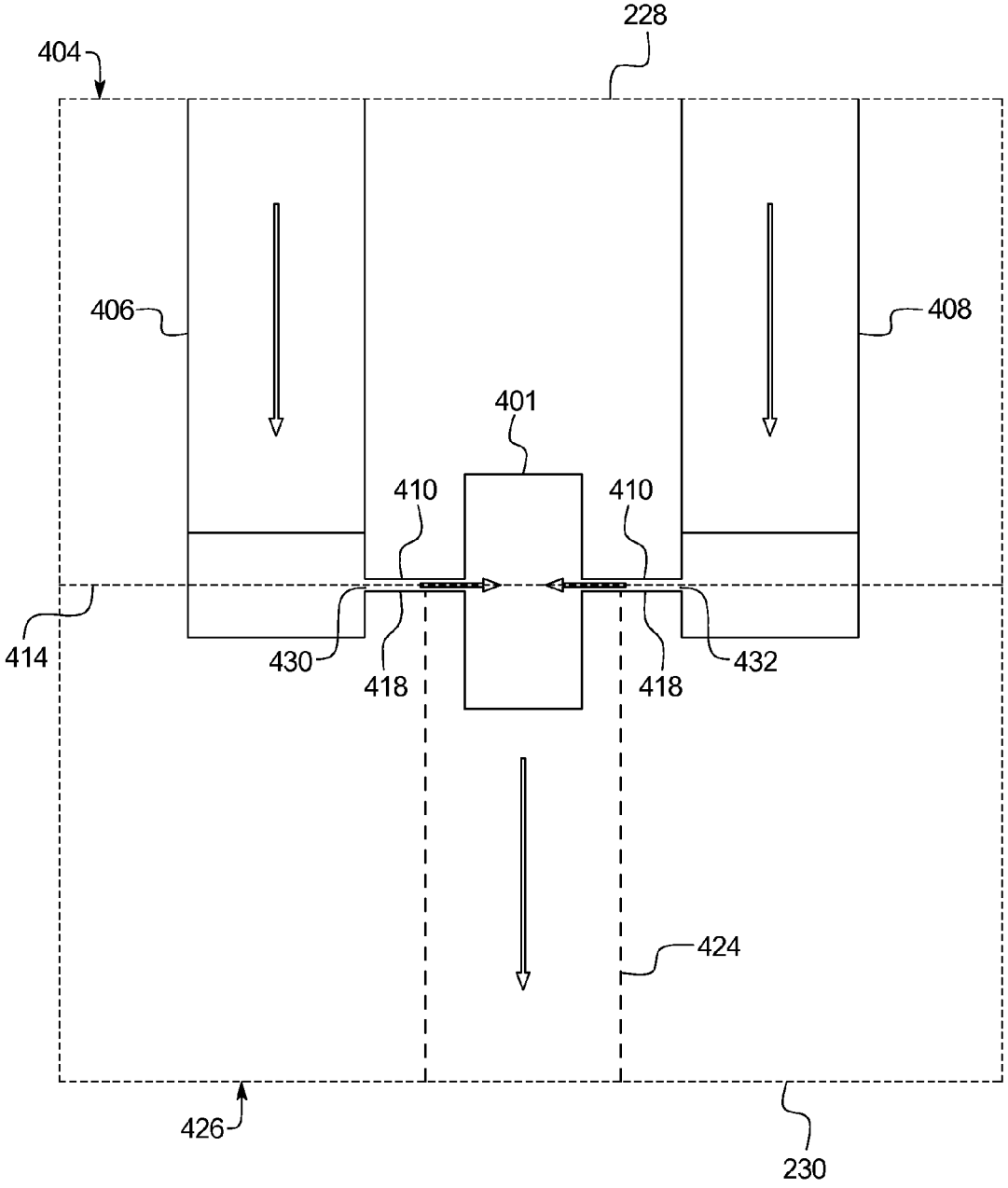
FIG. 9 (PRIOR ART)
FIG. 9 is a side cross-sectional view of the inlet and outlet mixing chamber elements of the prior art device taken along line IX-IX of FIGS. 7 and 8.

Referring now to FIG. 9, a side cross-sectional view of the inlet mixing chamber element 228 and the outlet mixing chamber element 230 of a prior art device are illustrated. As more clearly illustrated in FIG. 9, the cross section of the microchannels 410 exiting from the ports 406 and 408 follow a right angular pathway. The fluid passes through port 406 and 408 of the inlet mixing chamber element 228 until it encounters the top of the outlet mixing chamber element 230. When the fluid flow reaches the top of the outlet mixing chamber element, it is interrupted and is forced to flow through the microchannels 410/418 into the mixing chamber. In the prior art device, the microchannels 410/418 have a constant cross-sectional shape, and terminate at the outer radial end of port 406 and port 408 respectively. This prior art construction of the microchannels 410/418 creates a corner 430, 432 where the port meets the microchannels. The corner 430 is created between the base of port 406 and the top base of the microchannel 418 of outlet mixing chamber element 230. The corner 432 is created between the base of port 408 and the top base of the microchannel 418 of outlet mixing chamber element 230.

As illustrated in FIGS. 7 to 9, the prior art devices include a flow path that continues through the inlet ports 406, 408 and redirects the fluid to the outlet mixing chamber element 230 through an abrupt right angle turn into the microchannels 410/418 at corners 430, 432. It should be appreciated that, when the fluid is pumped at high pressure into the right angle flow path inlets of the prior art device, flow resistance is increased as the particles get trapped and are unable to flow freely into the microchannels and the mixing chamber 401 when the flow path changes direction. As a result of increased flow path resistance, the corresponding discharge coefficient is reduced. As discussed above, when the fluid to be mixed is discharged at a higher rate, the particle size decreases upon impact in the mixing chamber, thereby resulting in a more efficient and consistent mixture. Therefore, it is advantageous to decrease the flow resistance of the mixing inlet configuration and increase the discharge coefficient.

Referring now to FIGS. 10 to 12, an example mixing chamber embodiment of the present invention is discussed and illustrated. In FIG. 10, the inlet mixing chamber element 112 includes a top surface 304, configured to contact the inlet retaining element 108 when inserted into the first opening 115 of the first housing 102. The inlet mixing chamber element 112 also includes a plurality of ports 300, 302 extending from surface 304 toward bottom surface 306. Ports 300, 302 are small, and it should be appreciated that FIGS. 10 to 12 have been drawn out of scale for illustrative and explanatory purposes. On bottom surface 306 of the inlet mixing chamber element 112, a plurality of microchannels 308 are etched. The ports 300, 302 are in fluid communication with microchannels 308.

In FIG. 11, the outlet mixing chamber element includes a top surface 310, a bottom surface 311 and a plurality of ports 314, 315 extending from top surface 310 to bottom surface 311. In one embodiment, a plurality of microchannels 312 are etched into top surface 310 of the outlet mixing chamber element 114. The microchannels 312 are in fluid communication with outlet ports 314 and 315 through mixing chamber 301.

In operation in one embodiment, the inlet mixing chamber element 112 and the outlet mixing chamber element 114 are abutted against one another under high pressure in the mixing assembly. In one embodiment, the microchannels 308 of the inlet mixing chamber element 112 and the microchannels 312 of the outlet mixing chamber element 114 complement one another to create fluid-tight micro flow paths when the mixing chamber elements 112, 114 are fully assembled. Microchannels 312 on surface 310 of the outlet mixing chamber element 114 are configured to line up with microchannels 308 on surface 306 of the inlet mixing chamber element 112 of FIG. 10 when the two mixing chamber elements are aligned and sealingly abutted against one another. The micro flow paths created by microchannels 308 and 312 provide a fluid path leading from the top surface of the inlet mixing chamber element 112, through the ports 300, 302, through the micro flow paths, into the mixing chamber, and out the ports 314, 315 of the outlet mixing chamber element 114.

As discussed generally above and illustrated in detail in FIGS. 10 to 12, the microchannels 308 and 312 are specifically constructed in the inlet mixing chamber element 112 and the outlet mixing chamber element 114 respectively to encourage a low-turbulence flow of the liquid from the ports 300, 302 toward the outlet mixing chamber element 314. In FIG. 12, a side cross-sectional view of the inlet mixing chamber element 112 and the outlet mixing chamber element 114 of one example embodiment of the present invention are illustrated. In various embodiments, after the fluid is pumped into the ports 300, 302 of the inlet mixing chamber element, it travels downward toward the top surface 310 of the outlet mixing chamber element 114. When the fluid flow encounters the outlet mixing chamber element 114, it changes direction and is discharged out of the plurality of micro flow paths defined by microchannels 308 and 312 into mixing chamber 301, where the fluid is mixed with the discharged fluid flow originating from the opposing micro flow path.

As seen in FIG. 12, one example embodiment of the present invention includes flow paths that do not follow a totally linear horizontal path from the ports 300, 302 to the mixing chamber 301. In various embodiments, the microchannels are etched into the inlet mixing chamber element 112 to create a sweeping cross-sectional shape with a curved radius leading from the inlet port 300 to the mixing chamber 301. In the inlet mixing chamber element 112, the depths of the microchannels 308 etched on the bottom surface 306 are adjusted to create the curved cross section. In one embodiment, the etching is deeper on the bottom surface 306 at the outer radial portion where the microchannel meets the base of port 300, 302, and gradually shallower toward the inner radial portion of the inlet mixing chamber element 112. Correspondingly, on the outlet mixing chamber element 114, the microchannels 312 etched onto the top surface 310 are adjusted to complement the microchannels 108 on the inlet mixing chamber element 112 to create curved micro flow paths when the two mixing chamber elements are sealingly abutted against one another. In one embodiment, the etching is shallower on the top on the top surface 310 at the outer radial portion of where ports 300 and 302 line up with outlet mixing chamber element 114. The depth of the etching for the microchannels 312 of outlet mixing chamber element 114 gradually increases toward the inner radial portion of the outlet mixing chamber element 114. In one embodiment of the present invention, the micro flow paths have a generally rectangular cross-section. In another embodiment, the micro flow paths have a generally round cross-section.

It should be appreciated that in various embodiments, when the inlet mixing chamber element 112 and the outlet mixing chamber element 114 are sealingly pressed together, the variable-depth microchannels in each of the bottom surface 306 and the top surface 310 create a micro fluid flow path that is curved. In one embodiment, the combination of the two mixing chamber elements 112, 114 results in fluid flow paths of substantially consistent cross-sectional shape, due to the precise microchannel variable depth control exercised in manufacture. The curved micro fluid flow path provides a route for fluid to be pumped from the ports 300, 302 to the mixing chamber 301 without encountering a sharp right angle turn, present in the prior art of FIGS. 7 to 9. As will be discussed in more detail below, the gradual introduction of the fluid from a first direction to a substantially second perpendicular direction advantageously results in significantly less flow resistance, and therefore a higher discharge rate of the fluid.

Referring now to FIG. 12, a cross-sectional view of an assembly showing FIGS. 10 and 11 abutting against one another, along line XXII-XXII. The cross sectional view is taken along a line that bifurcates the mixing chamber elements 112 and 114 through the middle of the center microchannel 308/312. In one embodiment illustrated in FIG. 12, the curved inlets leading from the base of ports 300 and 302 to the micro flow paths 308/312 has a flared shape. In various embodiments, this flared shape is shaped substantially similar to a horn, with a significantly wider opening than the dimensions of the micro flow path.

In one embodiment, as the fluid is pumped through the curved micro fluid flow paths, the flow rate can be calculated according to the formula Q=vwh, where Q is the flow rate, v is the velocity of the fluid in the micro fluid flow path, w is the width of the microchannel, and h is the height or depth of the microchannel. The velocity, v, is calculated according to the formula $$v = C_d\sqrt{\frac{2\Delta P}{\rho}}$$

where $C_d$ is the discharge coefficient, ΔP is the process pressure and ρ is the fluid density. As can be appreciated from the velocity formula, the closer that the discharge coefficient is to 1, the higher the velocity of the fluid exiting the micro fluid flow paths. Similarly, if the discharge coefficient is lower, to achieve a certain flow rate, the process pressure has to increase.

It should be appreciated that, as evidenced by tests, an example prior art embodiment with right-angle micro fluid flow paths results in a discharge coefficient $C_d$ of between 0.62 and 0.68. As a result of the inefficient flow path and the corners present where the ports 406, 408 meet the top surface 414 of the outlet mixing chamber element 230, flow resistance is significant, and the fluid discharges at a lower velocity assuming constant process pressure and fluid density.

In contrast, as evidenced by tests, one example embodiment of the present invention with curved micro fluid flow paths results in a discharge coefficient $C_d$ of between 0.76 and 0.83. Due to the curved micro fluid flow path inlets, the fluid to be mixed has a more efficient route from the ports 300, 304 to the mixing chamber 301, and the interruption of an abrupt right angular change in direction present in the prior art is removed, thereby increasing the discharge coefficient. The increased discharge coefficient allows the mixing assembly to achieve higher levels of fluid velocity and fluid flow rate than the prior art under the same pressure. As discussed above, higher levels of fluid flow rate result in more efficient mixing and breakdown of the molecules into smaller particles. It should be appreciated that, in various example embodiments, the flow rate of the present invention is 20 to 50% higher than the flow rate of the prior art embodiment illustrated and described, with the same pressure and fluid density.

It should be appreciated that, by conserving energy as it flows in and maximizing the discharge coefficient and discharge velocity, the energy release is concentrated to the mixing chamber, rather than being wasted by resistance in the micro flow paths. As will be appreciated, when the energy and velocity is maximized in the mixing chamber, the mixture is optimized. Local turbulence in a confined micro flow path mixing chamber is promoted by increasing the micro flow path flow rates. Higher local turbulence brings about smaller length and time scales which means fast micro-mixing. For a set of fast precipitation reactions, if micro-mixing is very fast at which chemical reaction occurs, high local supersaturation of chemical reactive species is generated, which leads to a fast local nucleation rate and therefore small precipitate particle size with limited diffusional growth.

Besides achieving superior mixing, the shear rate of the fluid can also be maximized. In one embodiment, the shear rate is calculated according to the formula:

$$\gamma = \frac{2v}{h} = \frac{2Q}{C_d w h^2},$$

where v is the velocity of the fluid in the microchannel, h is the depth of the microchannel, Q is the flow rate, $C_d$ is the discharge coefficient and w is the width of the microchannel. As described above, the discharge coefficient of micro fluid mixers is significantly affected by the cross-sectional geometry of the micro fluid flow path inlet leading from the inlet ports to the mixing chamber. An increased flow rate also increases the shear rate inside of the micro fluid flow paths, which helps to reduce the particle size of the fluid for a top-down approach because the shear rate makes the particle experience different velocities at different portions which deforms it and tears it apart.

Figure 13:
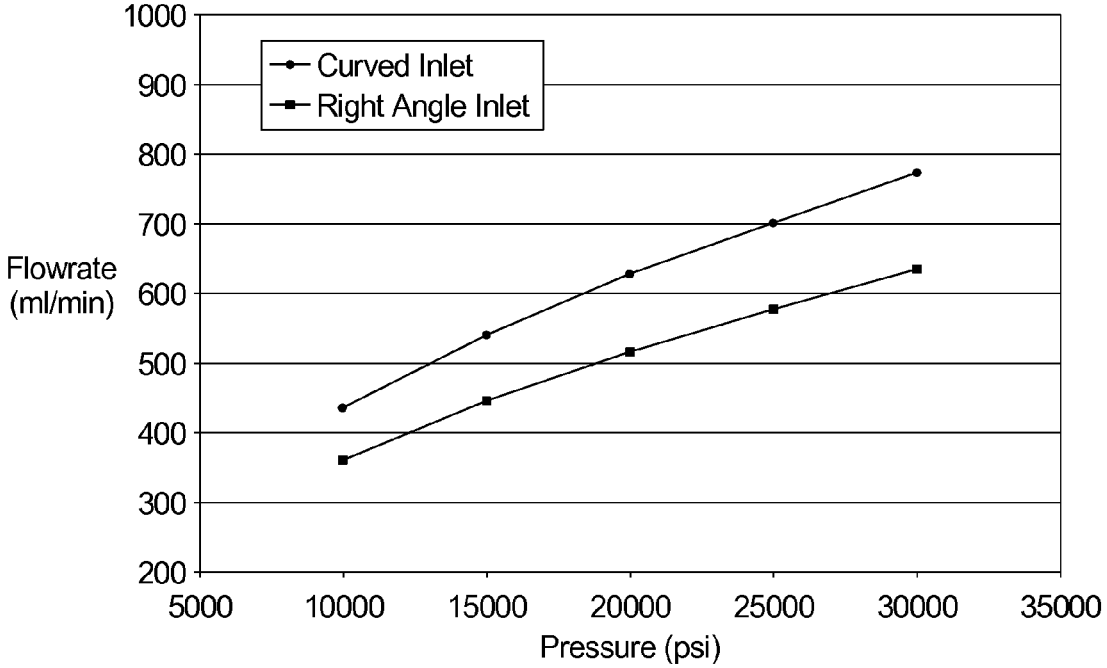
FIG. 13 is a chart plotting pressure and flowrate of one example embodiment of the present invention.
Figure 14:
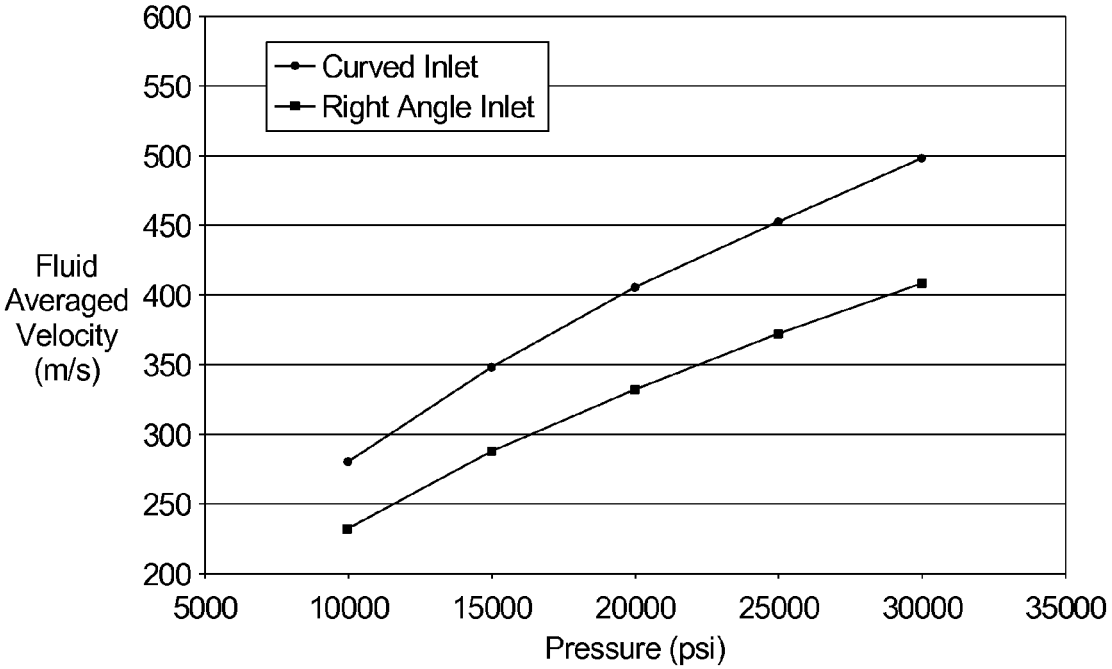
FIG. 14 is a chart plotting pressure and fluid averaged velocity of one example embodiment of the present invention.

Referring now to FIGS. 13 and 14, two charts showing the comparison between present curved inlet embodiments and the prior art embodiments are disclosed and discussed. The graph of FIG. 13 displays the results of a test in which the pressure of the fluid in pounds per square inch is plotted on the horizontal axis and the flow rate of the fluid in millimeters per minute is plotted on the vertical axis. The plotted curves each correspond to flow rates of two different fluid flow inlet geometries for pressures from 10,000 psi to 30,000 psi. The lower curve represents predicted flow rate data of a right-angle fluid flow inlet embodiment, and the upper curve represents measured flow rate data from the curved fluid flow inlet embodiment of the present disclosure. Given the slot size of the measured curved fluid flow inlet embodiment, the flowrate of a simulated right-angle fluid flow inlet embodiment with the same dimension flow paths can be easily calculated. It should be appreciated that the flow rates of the curved fluid flow inlets at given pressures are consistency higher than the predicted flow rates for right angle fluid flow inlets at the same corresponding pressures with the same cross-sectional sized fluid flow paths.

For example, see Tables 1 to 4 reproduced below, which include the data used to create the FIG. 13 chart. As can be appreciated, the size of the slot with the right angle inlet in Table 1 is the same as the size of the slot with the curved inlet in Table 3. As seen in Table 2, the flow rate, shear rate and jet velocity (depicted in FIG. 14 discussed below) for the right angle inlet are predicted for the pressures of 10,000 psi, 15,000 psi, 20,000 psi, 25,000 psi and 30,000 psi. Similarly, as seen in Table 4, the flow rate, shear rate and jet velocity for the curved angle inlet as measured in the test are shown for pressures of 10,000 psi, 15,000 psi, 20,000 psi, 25,000 psi and 30,000 psi. FIG. 13 shows the improved performance of fluid flow rate between the curved fluid flow inlet embodiment and the prior art right angle fluid flow inlet embodiment. FIG. 14 shows the improved performance of fluid averaged velocity in meters per second compared to pressure in pounds per square inch between the curved fluid flow inlet embodiment and the right-angle fluid flow inlet embodiment. As discussed above, due to the increased fluid flow efficiency of the disclosed curved inlet embodiment, the fluid can flow at a higher flow rate and velocity, thereby resulting in maximum energy released and optimum mixing.

TABLE 1

Size of single-slot with right angle inlet

| Depth (μm) | Width (μm) | Area ($\mu m^2$) |
|---|---|---|
| 94 | 274 | 25756 |

TABLE 2

Flow rate, shear rate and jet velocity of single-slot with right angle inlet

| Pressure (psi) | Flow rate (ml/min) | Shear rate ($s^{-1}$) | Jet velocity (m/s) |
|---|---|---|---|
| 10000 | 361 | 4965525 | 233 |
| 15000 | 446 | 6134693 | 288 |
| 20000 | 515 | 7083782 | 333 |
| 25000 | 577 | 7936587 | 373 |
| 30000 | 633 | 8706863 | 409 |

TABLE 3

Size of single-slot with curved inlet

| Depth (μm) | Width (μm) | Area ($\mu m^2$) | Inlet radius (μm) |
|---|---|---|---|
| 94 | 274 | 25756 | 150 |

TABLE 4

Flow rate, shear rate and jet velocity of single-slot with curved inlet

| Pressure (psi) | Flow rate (ml/min) | Shear rate ($s^{-1}$) | Jet velocity (m/s) |
|---|---|---|---|
| 10000 | 434 | 5969634 | 281 |
| 15000 | 539 | 7413900 | 348 |
| 20000 | 628 | 8638088 | 406 |

TABLE 4-continued

| Flow rate, shear rate and jet velocity of single-slot with curved inlet | | | |
|---|---|---|---|
| Pressure (psi) | Flow rate (ml/min) | Shear rate ($s^{-1}$) | Jet velocity (m/s) |
| 25000 | 701 | 9642197 | 453 |
| 30000 | 770 | 10591286 | 498 |

It will be understood that the mixing chamber elements of the present disclosure succeed in reducing the flow resistance of fluid to be mixed by creating a curved micro fluid inlet from the ports of the inlet mixing chamber element to the mixing chamber. The reduced flow resistance results in a higher discharge coefficient and therefore higher fluid flow rates. In addition to higher fluid flow rates, the shear rate increases, which helps to reduce particle size and promote efficient mixing. These features improve the quality of mixing and also allow for lower pressures to achieve higher flow rates than the prior art mixing devices. In addition to saving cost and resources, the present disclosure performs consistently and reliably, and can advantageously be configured to operate with current machines needing no modification. In various embodiments, the microchannels 308, 312 are etched into the respective mixing chamber elements 112, 114 using laser micromachining. It should be appreciated that using laser micromachining ensures repeatability of manufacture and provides significant cost savings over alternative forms of manufacture.

In one example embodiment of the present disclosure, the mixing chamber assembly includes a first mixing chamber element and a second mixing chamber element sealingly aligned with the first mixing chamber element. The first and second mixing chamber elements are configured to accept a high pressure fluid flow along a flow path. The flow path extends in a first direction through a plurality of ports in the first mixing chamber element and then extends through a curved transitional portion of the first mixing chamber element from the plurality of ports to a plurality of micro fluid paths defined by the first and second mixing chamber elements. Following the curved transitional portion, the flow path leads through the plurality of micro fluid paths in a second direction from the curved transitional portion to the mixing chamber defined by the first and second mixing chamber elements, the second direction substantially perpendicular to the first direction. The flow path then extends into the mixing chamber through a second plurality of ports in the second mixing chamber element in the first direction.

In another example embodiment of the present disclosure, a method of mixing a fluid is disclosed. The method comprises pumping a fluid in a first direction through a plurality of inlet fluid ports defined in a mixing assembly into a plurality of micro fluid flow paths in a second substantially perpendicular direction. The micro fluid flow paths include a transition portion curved from the first direction of the inlet fluid ports to the second substantially perpendicular direction of the micro fluid paths. The method then includes discharging the fluid from the micro fluid flow paths into a mixing chamber and mixing the fluid in the mixing chamber. The fluid is mixed by directing paths of the discharged fluid to a specific location in the mixing chamber. The mixed fluid is then evacuated from the mixing assembly through a plurality of outlet ports in the first direction.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

We claim:

1. A mixing chamber assembly, comprising:

(a) a first mixing chamber element having a first surface and an inlet port;

(b) a second mixing chamber element having a second surface and an outlet port, the second surface sealingly engaged with the first surface of the first mixing chamber element;

(c) a micro fluid path defined between the first and second mixing chamber elements and having an input end at the inlet port;

(d) a flared transitional portion defined at the input end of the micro fluid path and providing fluid communication between the inlet port and the micro fluid path; and (e) a mixing chamber defined by the first and second mixing chamber elements and in fluid communication with the micro fluid path and the outlet port;

wherein the first and second mixing chamber elements are configured to accept a high pressure fluid flow along a flow path, the flow path:

(1) extending in a first direction toward the first and second surfaces through the inlet port, (2) extending through the flared transitional portion from the inlet port to the micro fluid path;

(3) extending along the micro fluid path in a second direction from the flared transitional portion to the mixing chamber; and (4) extending from the mixing chamber through the outlet port in a third direction away from the first and second surfaces.

2. The mixing chamber assembly of claim 1, wherein the first direction and the third direction are the same.

3. The mixing chamber assembly of claim 1, wherein the first direction is substantially perpendicular to the second direction.

4. The mixing chamber assembly of claim 1, wherein the second direction is substantially perpendicular to the third direction.

5. The mixing chamber assembly of claim 1, wherein the second direction is parallel to the first and second surfaces.

6. The mixing chamber assembly of claim 1, wherein the flared transition portion has a curved wall.

7. The mixing chamber assembly of claim 6, wherein the flared transition portion has an arcuate wall.

8. The mixing chamber assembly of claim 1, wherein the micro fluid path is located in a channel etched in the first surface.

9. The mixing chamber assembly of claim 1, wherein the microfluid path is located in a channel etched in the second surface.

10. The mixing chamber assembly of claim 1, wherein the micro fluid path is located in a pair of aligned channels etched in the first and second surfaces.

11. The mixing chamber assembly of claim 1, wherein the first and second mixing chamber elements define a plurality of micro fluid channels each in fluid communication with the inlet port and the mixing chamber.

12. The mixing chamber assembly of claim 11, where the first mixing chamber element includes a plurality of inlet ports in fluid communication with the plurality of micro fluid channels.

13. The mixing chamber assembly of claim 11, wherein each of the plurality of micro fluid channels has a corresponding curved transition portion.

14. The mixing chamber element of claim 1, wherein the micro fluid path has a variable depth.

15. The mixing chamber assembly of claim 14, wherein flared transitional portion is provided by making the micro fluid path deeper where the micro fluid path meets the inlet port and gradually shallower moving away from the port.

16. The mixing chamber assembly of claim 1, wherein flared transitional portion is provided by making the micro fluid path wider where the micro fluid path meets the inlet port and gradually narrower moving away from the port.

17. The mixing chamber assembly of claim 1, wherein the micro fluid path is laser etched in at least one of the first and second surfaces.

18. The mixing chamber assembly of claim 1, wherein the micro fluid path has a generally rectangular cross section.

19. The mixing chamber assembly of claim 1, wherein the micro fluid path has a generally round cross section.

20. The mixing chamber assembly of claim 1, wherein the second direction is generally parallel to the first and second surface, and the first and third directions are generally perpendicular the first and second surface.

21. A mixing chamber assembly, comprising:

(a) a first mixing chamber element having a first surface and an inlet port;

(b) a second mixing chamber element having a second surface and an outlet port, the second surface sealingly engaged with the first surface of the first mixing chamber element;

(c) a micro fluid path defined between the first and second mixing chamber elements;

(d) a flared transitional portion flared towards at least one of the first surface and the second surface and providing fluid communication between the inlet port and the micro fluid path; and (e) a mixing chamber defined by the first and second mixing chamber elements and in fluid communication with the micro fluid path and the outlet port;

wherein the first and second mixing chamber elements are configured to accept a high pressure fluid flow along a flow path, the flow path:

(1) extending in a first direction toward the first and second surfaces through the inlet port, (2) extending through the flared transitional portion from the inlet port to the micro fluid path;

(3) extending along the micro fluid path in a second direction from the flared transitional portion to the mixing chamber; and (4) extending from the mixing chamber through the outlet port in a third direction away from the first and second surfaces.

22. The mixing chamber assembly of claim 21, wherein the flared transition portion gradually decreases the cross-sectional area of the micro fluid path from the inlet port.

23. The mixing chamber assembly of claim 21, wherein the flared transition portion causes the cross-sectional area of the micro fluid path to be largest at the inlet port.

24. The mixing chamber assembly of claim 21, wherein the flared transitional portion is flared towards the first surface.

25. The mixing chamber assembly of claim 21, wherein the flared transitional portion is flared towards the second surface.

26. The mixing chamber assembly of claim 21, wherein the flared transition portion has a curved wall.

27. The mixing chamber assembly of claim 26, wherein the flared transition portion has an arcuate wall.

28. The mixing chamber assembly of claim 21, wherein the micro fluid path is located in a channel etched in the first surface.

29. The mixing chamber assembly of claim 21, wherein the microfluid path is located in a channel etched in the second surface.

30. The mixing chamber assembly of claim 21, wherein the micro fluid path is located in a pair of aligned channels etched in the first and second surfaces.

31. The mixing chamber assembly of claim 21, wherein the first and second mixing chamber elements define a plurality of micro fluid channels each in fluid communication with the inlet port and the mixing chamber.

32. The mixing chamber assembly of claim 31, where the first mixing chamber element includes a plurality of inlet ports in fluid communication with the plurality of micro fluid channels.

33. The mixing chamber assembly of claim 31, wherein each of the plurality of micro fluid channels has a corresponding curved transition portion.

34. The mixing chamber element of claim 21, wherein the micro fluid path has a variable depth.

35. The mixing chamber assembly of claim 34, wherein flared transitional portion is provided by making the micro fluid path deeper where the micro fluid path meets the inlet port and gradually shallower moving away from the port.

36. The mixing chamber assembly of claim 21, wherein flared transitional portion is provided by making the micro fluid path wider where the micro fluid path meets the inlet port and gradually narrower moving away from the port.

37. A mixing chamber assembly, comprising:

(a) a first mixing chamber element having a first surface and an inlet port;

(b) a second mixing chamber element having a second surface and an outlet port, the second surface sealingly engaged with the first surface of the first mixing chamber element;

(c) a micro fluid path etched into at least one of the first surface and the second surface and defined as a generally straight path between the first and second mixing chamber elements;

(d) a flared transitional portion defined between the first and second mixing chamber elements and providing fluid communication between the inlet port and the micro fluid path; and (e) a mixing chamber defined by the first and second mixing chamber elements and in fluid communication with the micro fluid path and the outlet port;

wherein the first and second mixing chamber elements are configured to accept a high pressure fluid flow along a flow path, the flow path:

(1) extending in a first direction toward the first and second surfaces through the inlet port, (2) extending through the flared transitional portion from the inlet port to the micro fluid path;

(3) extending along the micro fluid path in a second direction from the flared transitional portion to the mixing chamber; and (4) extending from the mixing chamber through the outlet port in a third direction away from the first and second surfaces.

38. The mixing chamber assembly of claim 37, wherein the micro fluid path is defined as a generally horizontal path between the first and second mixing chamber elements.

39. The mixing chamber assembly of claim 37, wherein the flared transition portion has a curved wall.

40. The mixing chamber assembly of claim 39, wherein the flared transition portion has an arcuate wall.

41. The mixing chamber assembly of claim 37, wherein the micro fluid path is located in a channel etched in the first surface.

42. The mixing chamber assembly of claim 37, wherein the microfluid path is located in a channel etched in the second surface.

43. The mixing chamber assembly of claim 37, wherein the micro fluid path is located in a pair of aligned channels etched in the first and second surfaces.

44. The mixing chamber assembly of claim 37, wherein the first and second mixing chamber elements define a plurality of micro fluid channels each in fluid communication with the inlet port and the mixing chamber.

45. The mixing chamber assembly of claim 44, where the first mixing chamber element includes a plurality of inlet ports in fluid communication with the plurality of micro fluid channels.

46. The mixing chamber assembly of claim 44, wherein each of the plurality of micro fluid channels has a corresponding curved transition portion.

47. The mixing chamber element of claim 37, wherein the micro fluid path has a variable depth.

48. The mixing chamber assembly of claim 47, wherein flared transitional portion is provided by making the micro fluid path deeper where the micro fluid path meets the inlet port and gradually shallower moving away from the port.

49. The mixing chamber assembly of claim 37, wherein flared transitional portion is provided by making the micro fluid path wider where the micro fluid path meets the inlet port and gradually narrower moving away from the port.

* * * * *